United States Patent [19]

Drungil

[11] 4,095,522

[45] Jun. 20, 1978

[54] SOUND ABATEMENT DEVICE FOR MECHANICAL PRESSES

[75] Inventor: Walter J. Drungil, Chicago, Ill.

[73] Assignee: Verson Allsteel Press Company, Chicago, Ill.

[21] Appl. No.: 812,163

[22] Filed: Jul. 1, 1977

[51] Int. Cl.[2] ..... B30B 1/26

[52] U.S. Cl. ..... 100/214; 72/450; 83/701; 100/257; 100/282; 403/23

[58] Field of Search ..... 100/214, 282, 292, 257, 100/299; 277/181, 182; 181/211; 83/701, 859; 72/450

[56] References Cited

U.S. PATENT DOCUMENTS

| | | | |
|---|---|---|---|
| 818,172 | 4/1906 | Hill | 100/214 |
| 1,952,876 | 3/1934 | Lucey | 403/23 |
| 2,185,096 | 12/1939 | Treer | 100/257 |

*Primary Examiner*—Billy J. Wilhite
*Attorney, Agent, or Firm*—Wallenstein, Spangenberg, Hattis & Strampel

[57] ABSTRACT

A sound abatement device for large mechanical presses of the type which employ large gears and operate at relatively high speeds. The device is especially adapted to reduce noises emanating from the enclosed crown of such presses where the press gearing, drive means and bearings are located, and, to this end, the device desirably is positioned in openings in the base of the enclosed crown through which the pitmans or connecting links for moving the slide or ram of the press extend, and through which the crown generated noises normally are released. The device, while being positioned in the openings through which the pitmans or connecting links extend, does not interfere with, or impede, the vertical and oscillating movements thereof.

8 Claims, 16 Drawing Figures

FIG. 3
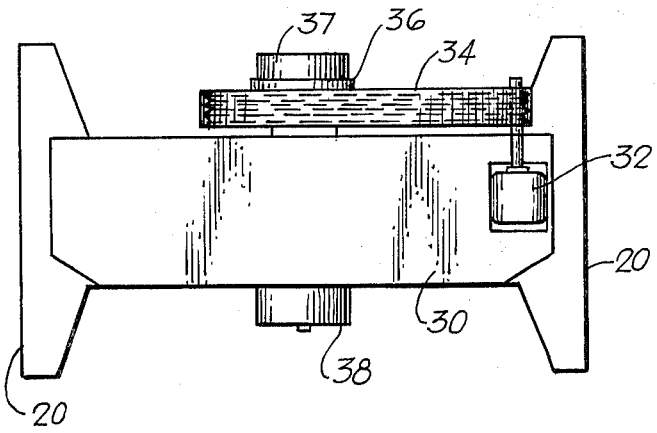
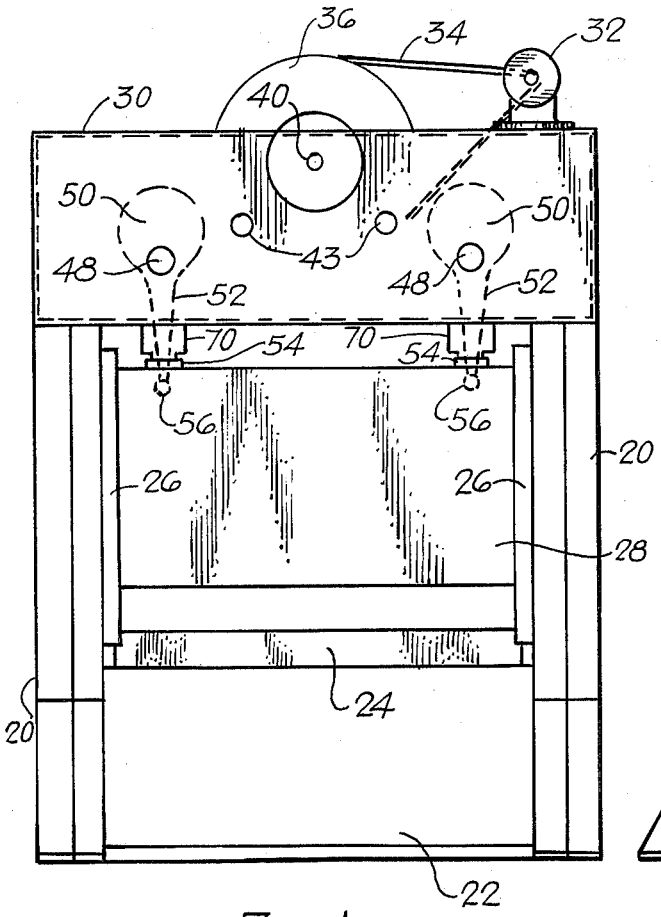
FIG. 1
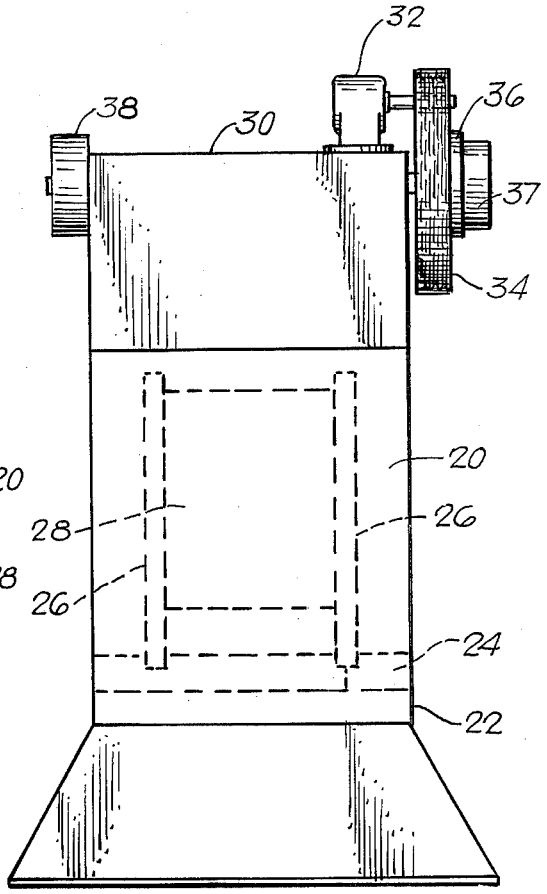
FIG. 2

72
72a
72b
72c
72d
92
50
52
48
90
30a
30
54a
62
54
56
64
66
28
60
68
94
96
96a
58
8B

SOUND ABATEMENT DEVICE FOR MECHANICAL PRESSES

The present invention relates to a sound abatement device for mechanical presses, particularly large mechanical presses having capacities of the order of 100 tons, or more.

Such mechanical presses normally include a bed supporting a bolster carrying tooling and a reciprocatable slide carrying tooling for performing work functions on a workpiece, an enclosed crown above the reciprocatable slide supported by columns carried by the bed, mechanical gearing and drive means in the enclosed crown, and one or more links operated by the mechanical gearing and drive means in the enclosed crown and extending through an opening or openings in the base of the enclosed crown to the slide for reciprocating the slide to perform the work functions on the workpiece. As the slide is being lowered during the power stroke and the workpiece is engaged by the tooling to perform the work function thereon, substantial resistance to the downward movement of the slide is suddenly encountered and the resistance is transmitted by the link or links back to the mechanical gearing and drive means in the enclosed crown, placing sudden and great stress thereon and on the frame of the press. Such sudden and great stress causes considerable vibration and noise in the press and particularly in the mechanical gearing and drive means in the enclosed crown of the press from wherein such noise escapes through the openings in the base of the crown which accommodate the links extending from the drive means in the crown to the press slide.

Noise control in such mechanical presses, particularly large presses of the type having capacities of 100 tons, or greater, and operating speeds ranging from about 15 to about 60 strokes per minute, presents a continuing, complex and costly problem. Attempts at reducing the noise problems inherent in the operation of such presses have involved the use of sound dampening materials and heavy gauge structural components to lessen vibration, the use of sound absorption materials and sound barriers, and the use of sound containment means for minimizing the escape of sound from within the crown through the link accommodating openings in the base thereof. Exemplary of the last-mentioned means are flexible closures such as bellows-like boots. Closures of this type are adapted to be positioned at the openings in the base of the crown of mechanical presses, and, in operation, are extended and retracted in an accordian-like manner in response to the vertical and oscillatory movement of the pitmans or connecting links which are connected at one end to the drive means in the crown and at the other end to the slide or ram of the press. Because the boots are subjected to continuous flexing during operation of the press, they have a relatively short useful life. Another problem associated with the use of this type of closure is that during operation of the press at higher speeds, the bellows act like an air pump, that is, on the down stroke of the pitman or connecting link, the bellows will collapse, and on the upstroke, the bellows will inflate like a balloon.

In accordance with the present invention, a sound abatement device adapted to contain noises emanating from within the crown of a mechanical press is provided which eliminates the shortcomings, noted above, encountered with bellows-like boots heretofore used for such purpose. The device comprises an open-ended, movable body portion which is vertically reciprocated with the slide and which is vertically reciprocatably received in an opening in the base of the crown of a mechanical press through which a movable link member such as a pitman, connecting link, toggle link, or the like, extends. One end of the link member is engaged with the mechanical drive means, such as a crankshaft housed within the crown, while the other end is connected to the ram or slide of the press through a connection housing secured to the slide. The end of the connection housing farthest removed from the ram or slide is always in spaced relation to the opening in the base of the crown whether the slide is up or down. The movable body portion is slidably received in the opening in the crown and a retainer or frame is secured on the base of the crown at said opening. The frame carries a resilient, flexible, sound-sealing guide member which is maintained in slidable engagement with the side wall of the body portion.

In one form of the device, the sidewall of the body portion has a uniform transverse dimension throughout its length and it is secured and sealed to the outer wall of the connection housing at the upper end thereof thereby closing off the space normally present between the opening in the crown and the connection housing which, as stated, is mounted on the ram or slide of the press. The resilient guide member is contoured to slidably receive and seal the sidewall of the body portion extending into the opening in the crown. In another embodiment of the device, the body portion is provided with an extension in engagement with the wrist pin of the pitman or connecting link which is arranged within the connection housing. The connection housing contains a lubricant, such as oils into which the bottom open end of the body portion extends for sealing the same to the connection housing. This arrangement, as in the case of the first-mentioned form of the device, acts as a sound arresting closure for the space normally present between the opening in the base of the crown and the connection housing. In yet another embodiment of the invention, the body portion is formed with areas having different transverse dimensions to accommodate differences in dimensions and configurations between the opening in the base of the crown and the housing connection mounted on the ram or slide of the press. In all cases, the dimensions of the device are such that the movement of the link member, whether it be a pitman, connecting link, toggle link, or the like, is in no way impaired, or impeded. In addition, the device enables the gibs of a press to be adjusted in all directions without any adverse effect on the sound abatement function of the device. The utilization of the device on large mechanical presses has reduced by upwards of 50%, and more, the amount of noise emanating from the crown of the presses.

The foregoing, and other advantages and features of the sound abatement device of this invention will become clear from the following description when taken in conjunction with the accompanying drawings wherein:

FIG. 1 is a front view in elevation of a typical mechanical press in connection with which the sound abatement device of this invention is used;

FIG. 2 is a side view in elevation of the press shown in FIG. 1;

FIG. 3 is a top plan view of said press;

Figure 5:
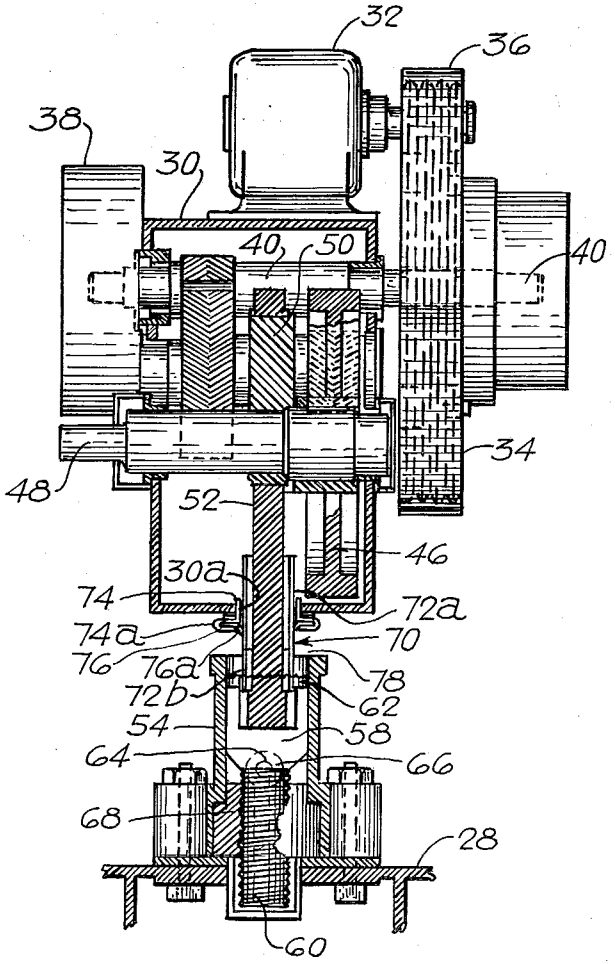
FIG. 5 is a fragmentary side view partly in section corresponding to the view of FIG. 4.

Referring, now to FIGS. 1 through 5 of the drawings, an embodiment of a large mechanical press shown somewhat schematically in FIGS. 1–3, comprises a pair of columns 20—20 secured to and supported by a bed 22. A bolster 24 is removably positioned on the bed 22 for holding tooling for performing work functions on a workpiece (not shown). Adjustable gibs 26—26 are mounted on the inner side of each of the columns 20—20 and are adapted to act as guideways for a ram or slide 28, also carrying tooling for performing work functions on a workpiece (not shown). Positioned at the top of the columns 20—20 is an enclosed crown 30 in which the mechanical gearing and drive mechanism for the ram or slide 28 is located. Tie rods (not shown) extend through the bed 22, the columns 20 and the crown 30 for adding rigidity and strength to the press. As illustrated, the crown 30 has a motor 32 mounted on the top thereof. The motor 32 continuously drives a plurality of V-belts 34 connected to a fly wheel 36 which, in turn, is releasably coupled by a clutch 37 to a drive shaft 40 extending from the front to the rear of the crown 30. A brake 38 for the drive shaft 40 is positioned on the opposite side of the crown 30. When the clutch 37 is engaged and the brake 38 disengaged, the continuously driven fly wheel 36 rotates the drive shaft 40 for moving the slide 28 and when the clutch is disengaged and the brake applied, rotation of the drive shaft is stopped.

Figure 4:
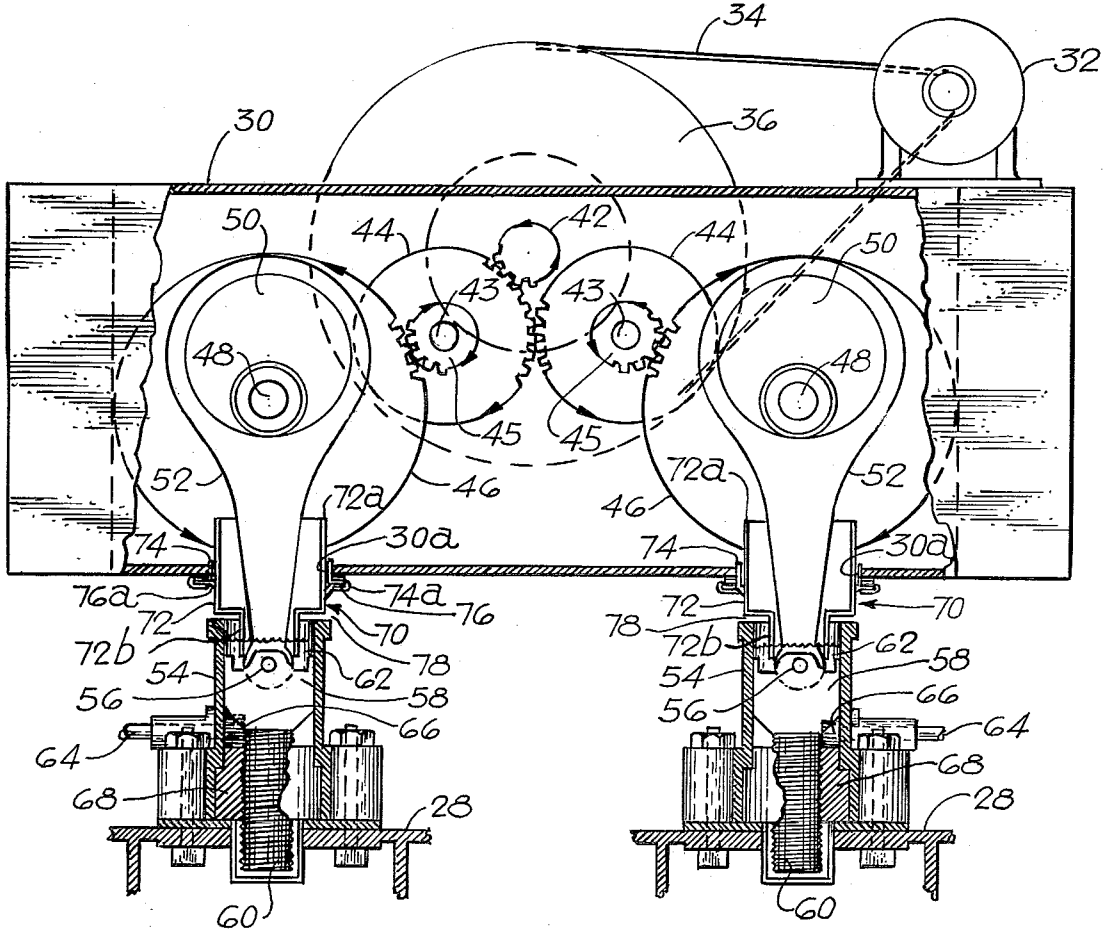
FIG. 4 is a fragmentary view partly in section of the crown and connection housing of the press shown in FIG. 1 illustrating an embodiment of the device as used in a double geared, twin drive arrangement for the ram or slide of the press.

The press shown in FIGS. 1 through 3 for purposes of illustration is of the double geared, twin drive type, and to this end, as best shown in FIGS. 4 and 5, the drive shaft 40 has a drive pinion 42 which rotates a pair of intermediate meshing gears 44—44 on intermediate shafts 43 which, in turn, through intermediate pinions 45, drive a pair of main gears 46—46 each of which is mounted on a crankshaft 48. Each crankshaft 48 has a crank in the form of an eccentric 50 for receiving an end of a connecting strap or pitman or link 52. The lower end of each pitman or link 52 extends through an opening 30*a* in the base of the crown 30, and into a slide-mounted connection housing 54 where it is joined by means of a wrist pin 56, to a head 58 of an externally threaded adjusting screw 60, the head 58 having a saddle to be engaged by the pitman or link 52 during the work performing operation of the press. A reservoir of oil 62 is maintained in the connection housing 54 above the head 58 of the screw 60. Vertical adjustment of the screw 60 is made by a power driven shaft 64 having a pinion 66 on the end thereof, the teeth of which are engaged with gear teeth on the upper margin of an internally threaded nut member 68 for rotating the same. By rotating the nut member 68, the vertical position of the head 58 may be vertically adjusted with respect to the slide 28 for adjustably positioning the slide with respect to the pitman or link 52. While the drive mechanism is shown and described as incorporating crankshafts having eccentrics mounted thereon on which the connecting straps or pitmans or links are engaged, the main gears may be mounted on straight shafts and provided with an integral eccentric hub on which the straps or pitmans or links are engaged. The capacity of a press such as the one illustrated in FIGS. 1 through 3 can, as stated, range from 100 tons and upwards. The speed of such a press can vary from about 15 strokes to about 60 strokes per minute.

In FIGS. 4 through 6A, and 9 through 11, an embodiment of the sound abatement device, designated by reference numeral 70, of this invention is illustrated. As shown in FIGS. 4 through 6A, the device 70 is positioned in the opening 30*a* in the base of the crown 30, and comprises an open ended enclosure 72 having a body portion 72*a* which is reciprocatably received in the opening 30*a* of the crown 30. The body portion 72*a* may be fabricated of metal, rigid plastic, or the like, material, and is provided with an extension 72*b* having ears 72*c* (see FIG. 9) with openings 72*d* therethrough for receiving and engaging the wrist pin 56 for vertical reciprocation with the wrist pin.

A frame 74, which desirably is made of metal, may be secured to the crown 30 at the opening 30*a* in the base thereof by any suitable fastening means such, for example, as screws (not shown). The frame 74 has a U-shaped bend 74*a* formed along its lower margin which receives a resilient, flexible, sound-sealing guide member 76 advantageously fabricated of a material such as rubber or plastic. The width of the guide member 76 is such that the inner free margin 76*a* thereof extends inwardly of the opening 30*a* in the crown 30, and resiliently engages the sidewalls of the body portion 72*a* of the enclosure 72. The margin 76*a* enables the body portion 72*a* to move vertically in an upward and downward path in response to the reciprocating movement of the wrist pin 56 caused by the pitman or link 52, and provides a constant noise seal as the body portion 72*a* moves in its vertical path. The flexible character of the margin 76*a* further enables the gibs 26 of the press to be adjusted in all directions, in a horizontal plane, without any adverse effect on the noise seal provided by the margin 76*a* with the sidewalls of the body portion 72*a*.

The dimensions of the enclosure 72 of the sound abatement device are such that the sidewalls of the body portion 72*a* thereof remain, as indicated, in continuous engagement with the flexible margin 76*a*, and the extension 72*b* of the enclosure 72 remains below the level of the reservoir of oil 62 in the connection housing 54 to seal the extension 72*b* throughout the full stroke of the pitman 52. Thus, the enclosure 72 closes off the space 78 normally present between the opening 30*a* in the base of the crown 30 and the movable connection housing 54, and provides an uninterrupted sound barrier at said opening. Also, the dimensions of the body portion 72*a* and the extension 72*b* of the enclosure 72 are such that the enclosure 72 does not in any way impede or interfere with the normal oscillating movement of the pitman or link 52. The configuration of the enclosure 72, of course, can be varied to adapt it to the configuration of the openings in the base of the crown.

Figures 6, 6A, 7, 7A, 7B:
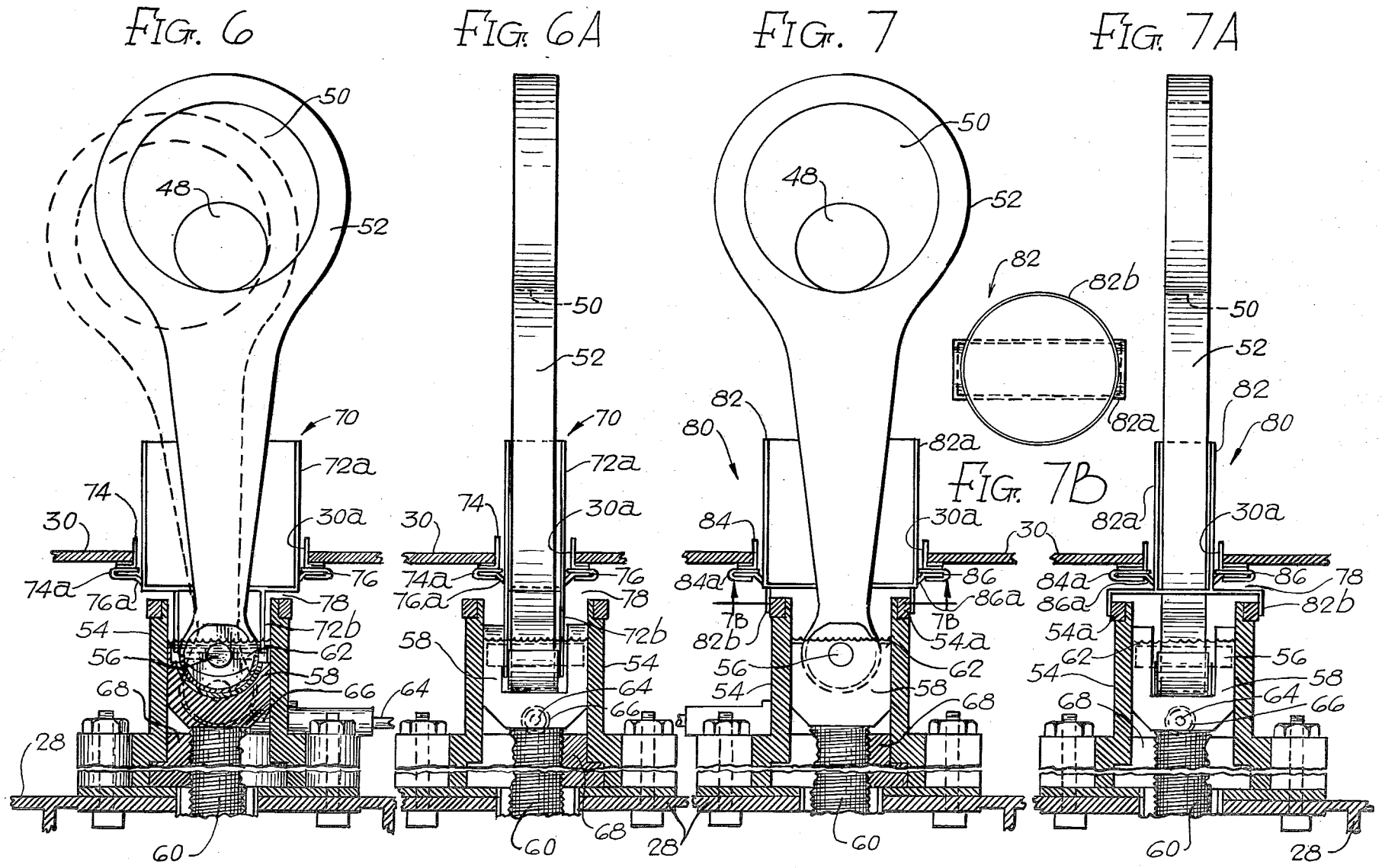
FIG. 6 is an enlarged fragmentary view partly in section illustrating an embodiment of the sound abatement device, and showing its position in relation to the crown and the connection housing during the power stroke of the movable link member.
FIG. 6A is a side view partly in section corresponding to the view of FIG. 6.
FIG. 7 is an enlarged fragmentary view partly in section showing another embodiment of the sound abatement device of this invention mounted in position on a mechanical press.
FIG. 7A is a side view partly in section corresponding to the view of FIG. 7.
FIG. 7B is a bottom view of the embodiment of the sound abatement device shown in FIGS. 7 and 7A.

Referring, now, to FIGS. 7 through 7B of the drawings, the embodiment of the device shown and designated by reference numeral 80 comprises an enclosure 82 having a body portion 82*a* which is generally rectangular in cross-section, and an extension 82*b* which is generally circular in cross-section. The body portion 82*a* of the device 80, like the embodiment of the device 70 described above, is reciprocatably received in the opening 30*a* in the base of the crown 30. The frame 84, like the frame 74, has a U-shaped portion 84*a* in which the outer margin of a resilient, flexible, sound-sealing guide member 86 is engaged. The free, inner margin 86*a* of the member 86 is in contact with, and remains in continuous contact with, the sidewalls of the body portion 82*a*. The enclosure 80, and the frame 82 and the member 86 advantageously are fabricated of the same materials as the corresponding components of the device 70.

The extension 82*b* of the enclosure 82, unlike the extension 72*b* of the enclosure 72, is attached directly to the connection housing 54. As shown in FIGS. 7 and 7A, the lower margin of the extension 82*b* is secured and sealed, as by screws, or the like, to the outer wall of a reinforcing ring or collar 54*a* provided on the housing 54 at the upper margin thereof. Thus, the enclosure 82, like the enclosure 72 closes off the space 78 normally present between the opening 30*a* in the base of the crown 30 and the top of the connection housing 54, and provides an uninterrupted sound barrier at said opening. Again, as in the case of the device 70, the flexible, sound-sealing guide member 86 permits the gibs 26 to be adjusted in all directions, and the dimensions of the enclosure 82 are such as to permit normal movement of the pitman or links 52 throughout its stroke.

Figures 8, 8A, 8B, 9, 10, 11:
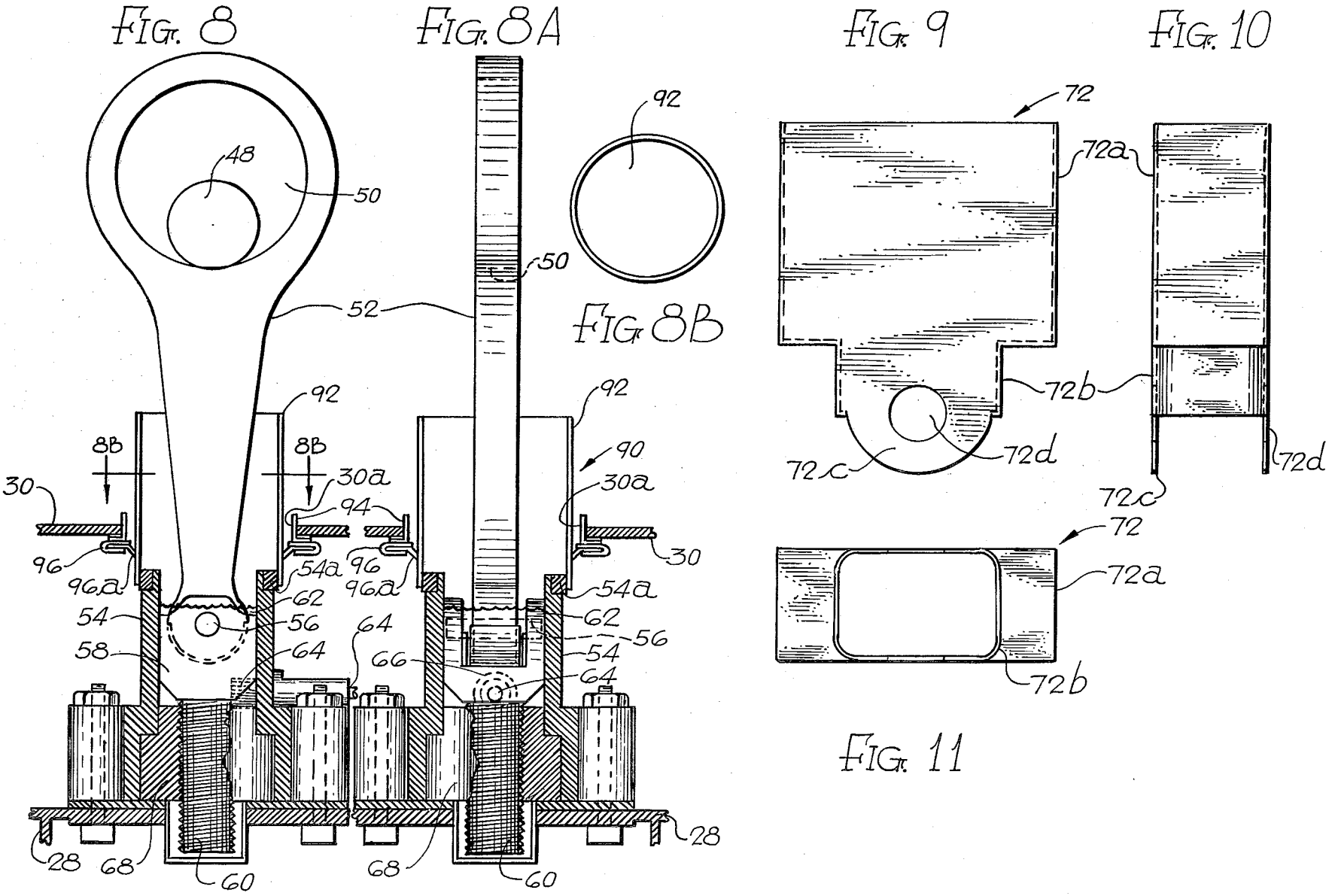
FIG. 8 is an enlarged fragmentary view partly in section showing yet another embodiment of the sound abatement device mounted on a mechanical press.
FIG. 8A is a side view partly in section corresponding to the view of FIG. 8.
FIG. 8B is a top plan view of the embodiment of the device shown in FIGS. 8 and 8A.
FIGS. 9 through 11 are enlarged side, end and bottom plan views, respectively, of the embodiment of the sound abatement device shown in FIGS. 6 and 6A.

In FIGS. 8 through 8B yet another embodiment of the sound abatement device of this invention is shown. As illustrated, the device, designated generally by reference numeral 90, comprises an open ended, substantially cylindrical enclosure 92 which is reciprocatably received in an opening 30*a* in the base of the crown 30. A frame 94, like the frames 74 and 84 of the previously described embodiments of the sound abatement device, has a U-shaped portion 94*a* which supports a flexible, sound-sealing guide member 96 having an inwardly extending free margin 96*a* which is in slidable engagement with the wall of the enclosure 92. As before, the enclosure 92, the frame 94 and its associated guide member 96 desirably are fabricated of the same materials as the corresponding components of the previously described devices 70 and 80.

The enclosure 92 of the device is attached and sealed, at its lower margin, to the outside of a reinforcing ring or collar 54*a* secured on the connection housing 54. Thus, again, the space normally present between the opening 30*a* in the base of the crown and the upper margin of the connection housing 54 is closed off and sealed against sounds generated in the crown from escaping through the opening 30*a*. The walls of the enclosure 92 are of sufficient length so that continuous, sound-sealing contact with the free margin 96*a* of the sound-sealing guide member 96 is maintained as the enclosure 92 is moved by the connection housing 54 in response to the oscillating movement of the pitman or link 52. Also, as in the case of the previously described embodiments of the device of this invention, the enclosure 92 does not interfere with the movement of the pitman or link 52, and the gibs 26 may be adjusted in all directions without in any way lessening the sound abating properties of the device 90.

While the invention has been illustrated and described with relation to certain specific embodiments thereof, it should be understood that variations in the details of the device as shown and described may be made by those skilled in the art without departing from the spirit and scope of the invention.

What is claimed is:

1. In a mechanical press having a bed for supporting a workpiece, a reciprocatable slide for performing work on the workpiece, an enclosed crown containing mechanical gear means and drive means associated therewith for reciprocating the slide with relation to the workpiece supported on the bed of the press, and a movable link member which extends through an opening in the base of the crown, said link member being joined at one end to the drive means in the crown and at its other end to the slide through a connection housing secured on the slide in spaced relation to the opening in the base of the crown, the improvement comprising: a sound abatement device positioned at the opening in the base of the crown for substantially reducing the amount of noise mechanically generated in the enclosed crown which normally would pass from the interior of the crown through the opening in the base thereof, said device including a rigid, open-ended body portion through which one end of the movable link member extends and which is movable in response to the movement of the slide, said body portion having side walls which are sealed with respect to the connection housing and which extend into the crown through the opening in the base thereof and which bridge the space between said opening in the crown and the connection housing secured on the slide thereby providing a sound barrier between the opening in the base of the crown and the connection housing, and flexible, sound-sealing guide means for the body portion, said guide means being maintained in constant slidable engagement with the side walls of the body portion as the body portion moves in response to the movement of the slide.

2. A sound abatement device according to claim 1 wherein the device includes a retaining member for the sound-sealing guide means, said retaining member being positioned on the crown at the opening in the base thereof.

3. A sound abatement device according to claim 2 wherein the sound-sealing guide means comprises a flexible gasket-like member having a central opening therethrough, the outer margin of the gasket-like member being secured on the retaining member and the inner margin thereof being in sound-sealing engagement with the body portion of the sound abatement device.

4. A sound abatement device according to claim 3 wherein the gasket-like member is formed of flexible rubber or flexible plastics material.

5. A sound abatement device according to claim 1 wherein the body portion of the device has an extension having side walls which extend inwardly of the connection housing and are sealed with respect thereto, said extension being joined internally of the housing to the slide.

6. A sound abatement device according to claim 1 wherein the body portion of the device is essentially cylindrical in shape, and the side walls of the body portion at one end thereof are sealed with respect to the periphery of the connection housing.

7. In a mechanical press having a bed for supporting a workpiece, a reciprocatable slide for performing work on the workpiece, an enclosed crown containing mechanical gear means and drive means associated therewith for reciprocating the slide with relation to the workpiece supported on the bed of the press, and a movable link member which extends through an opening in the base of the crown, said link member being joined at one end to the drive means in the crown and at its other end to the slide by means of a wrist pin positioned internally of a connection housing secured on the slide in spaced relation to the opening in the base of the crown, said connection housing having a reservoir of a liquid lubricant therein, the improvement comprising: a sound abatement device positioned at the opening in the base of the crown for substantially reducing the amount of noise mechanically generated in the enclosed crown which normally would pass from the interior of the crown through the opening in the base thereof, said device including a rigid, open-ended body portion through which one end of the movable link member extends and which is movable in response to the movement of the slide, said body portion having side walls which extend into the crown through the opening in the base thereof and an extension which bridges the space between said opening in the crown and the connection housing secured on the slide, said extension of the body portion having openings therethrough for receiving the wrist pin for joining the link member to the slide, said extension being at least partly immersed in the reservoir of liquid lubricant in the connection housing, the body portion thereby providing a sound barrier between the opening in the base of the crown and the connection housing, and flexible, sound-sealing member for the body portion, said sound-sealing member being maintained in constant slidable engagement with the side walls of the body portion as the body portion moves in response to the movement of the slide.

8. A sound abatement device according to claim 7 wherein a rigid retaining member is attached to the crown at the opening in the base thereof for supporting the sound-sealing member and maintaining it in constant sound-sealing slidable engagement with the side walls of the body portion.

* * * * *